US011240580B2

(12) United States Patent
Feinstein

(10) Patent No.: US 11,240,580 B2
(45) Date of Patent: Feb. 1, 2022

(54) MODULAR STAND FOR CONNECTING A MICROPHONE STAND TO A PEDAL BOARD

(71) Applicant: Maxwell DeSimone Feinstein, Jersey City, NJ (US)

(72) Inventor: Maxwell DeSimone Feinstein, Jersey City, NJ (US)

(73) Assignee: Maxwell DeSimone Feinstein, Jersey City, NJ (US)

( * ) Notice: Subject to any disclaimer, the term of this patent is extended or adjusted under 35 U.S.C. 154(b) by 4 days.

(21) Appl. No.: 16/586,156

(22) Filed: Sep. 27, 2019

(65) Prior Publication Data

US 2020/0275177 A1 Aug. 27, 2020

Related U.S. Application Data

(60) Provisional application No. 62/811,097, filed on Feb. 27, 2019.

(51) Int. Cl.
*H04R 1/08* (2006.01)
*G10H 1/34* (2006.01)

(52) U.S. Cl.
CPC ..... *H04R 1/08* (2013.01); *G10H 1/348* (2013.01)

(58) Field of Classification Search
CPC .. G10G 5/00; G10G 7/00; G10H 1/32; G10H 1/348; H04R 1/08
See application file for complete search history.

(56) References Cited

U.S. PATENT DOCUMENTS 5,994,634 A * 11/1999 Cady ..... G10D 13/00 84/421
6,637,707 B1 * 10/2003 Gates ..... A47B 81/005 211/64
7,412,069 B2 8/2008 Workman et al.
8,614,385 B2 * 12/2013 McKinney ..... G10H 1/348 84/453
D745,932 S 12/2015 Trifilio
9,484,009 B2 * 11/2016 Bethuy ..... G10H 1/348

OTHER PUBLICATIONS

Web page and photo of Jaime Rose board for the night; Retrieved on Jan. 4, 2019; from https://www.instagram.com/p/BLPaP9EgA10/.
Web page and photos of Gamut Modular Pipe Railings. Retrieved on Jan. 2, 2019 from Internet URL: www.gamut.cam/p/base-flange-aluminum-rectangular-ODk4otg3.

(Continued)

*Primary Examiner* — Brian Ensey
(74) *Attorney, Agent, or Firm* — Pergament & Cepeda LLP; Edward Pergament; Anila Kethe

(57) ABSTRACT

The present invention relates to a modular stand that connects the microphone stand directly to the pedal board, said modular stand comprises a first flange, a slat or railing based pedal board, an identical second flange, wherein the first flange is a rectangular metal structure consisting of two openings at the two distal ends and a central protrusion having threading on the inside surface; wherein the second flange is a rectangular metal structure consisting of openings at the two distal ends; wherein the flanges are connected there between by sturdy means such as a nut and bolt assembly; and wherein the central protrusion provides a structural means to support a microphone stand.

7 Claims, 4 Drawing Sheets

MODULAR STAND MOUNTED ON A SLAT/RAILING STYLE PEDAL BOARD
(part in the circle an enlarged portion of the mounted mod stand)

(56) References Cited

OTHER PUBLICATIONS

Web page and photos of On-Stage U Mount UM5006 Retrieved on Jan. 2, 2019 from Internet URL: https://on-stage.com/products/view/12056/237108.
Web page and photos of Rear Fender Aluminum Seat Screw Bolt Nut Mount Knob, Retrieved on Jan. 2, 2019 from Internet URL: https://www.ebay.com/itm/Rear-Fender-Aluminum-Seat-Screw-Bolt-Nut-Mount-Knob-Tab-Cover-ForHarley-97-Up-/282390082719.
Web page and photos of Zora Select EZ Riser Ceiling. Retrieved on Jan. 3, 2019 from Internet URL: https://www.zoro.com/zoro-select-ceiling-or-wall-rod-hanger-plate-iron-365m0037pl/i/G1251083#specifications.
Web page and photos of Core Equipment/PC95MCX—Pedal_Board. Retrieved on Jan. 2, 2019 from Internet URL: https://guitarcenter.com/CoreEquipment/PC95MCX/Pedal-Board.
Web page and photos of Ultimate Support GSP-500 Genesis Series Pedalboard. Retrieved on Jan. 2, 2019 from URL: musicstorelive.com/ultimate-support-gsp-500-genesis-series-pedalboard.
Web page and photos of On-Stage Stands GPA 1003. Retrieved on Jan. 2, 2019 from URL: https://sweetwater.com/store/detail/GPA1003-on-stage-stands-gpa.
Snapdragon Mic Stand Detachable Mic Stand System for Pedalboards. Retrieved on Jan. 2, 2019 message of Aug. 2, 2016 from Twitter.com/snapdragonstand, ©snapdragonstand.

* cited by examiner

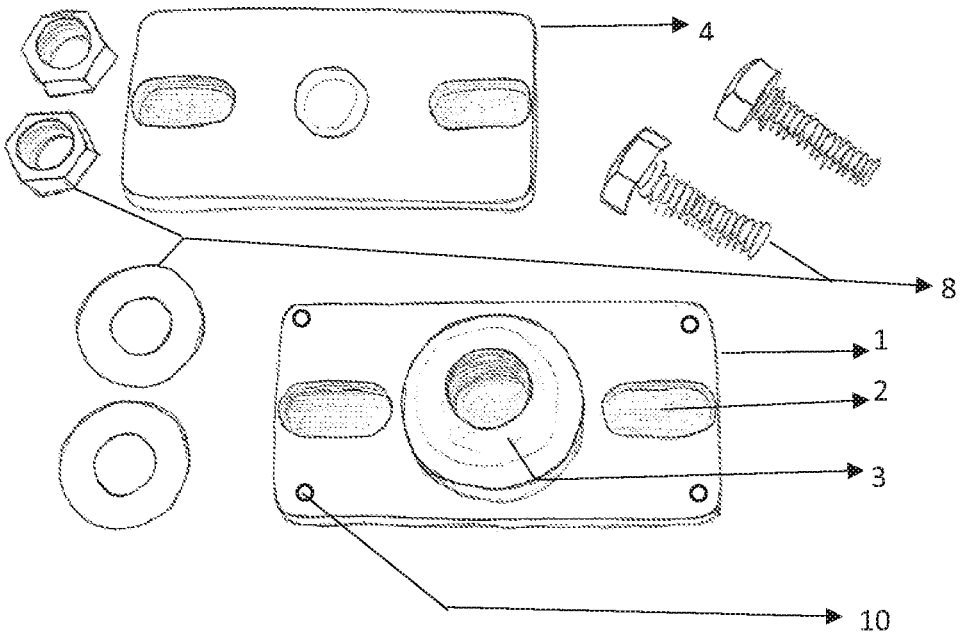
FIGURE 1: FIRST FLANGE AND AN IDENTICAL SECOND FLANGE OF THE MODULAR STAND.

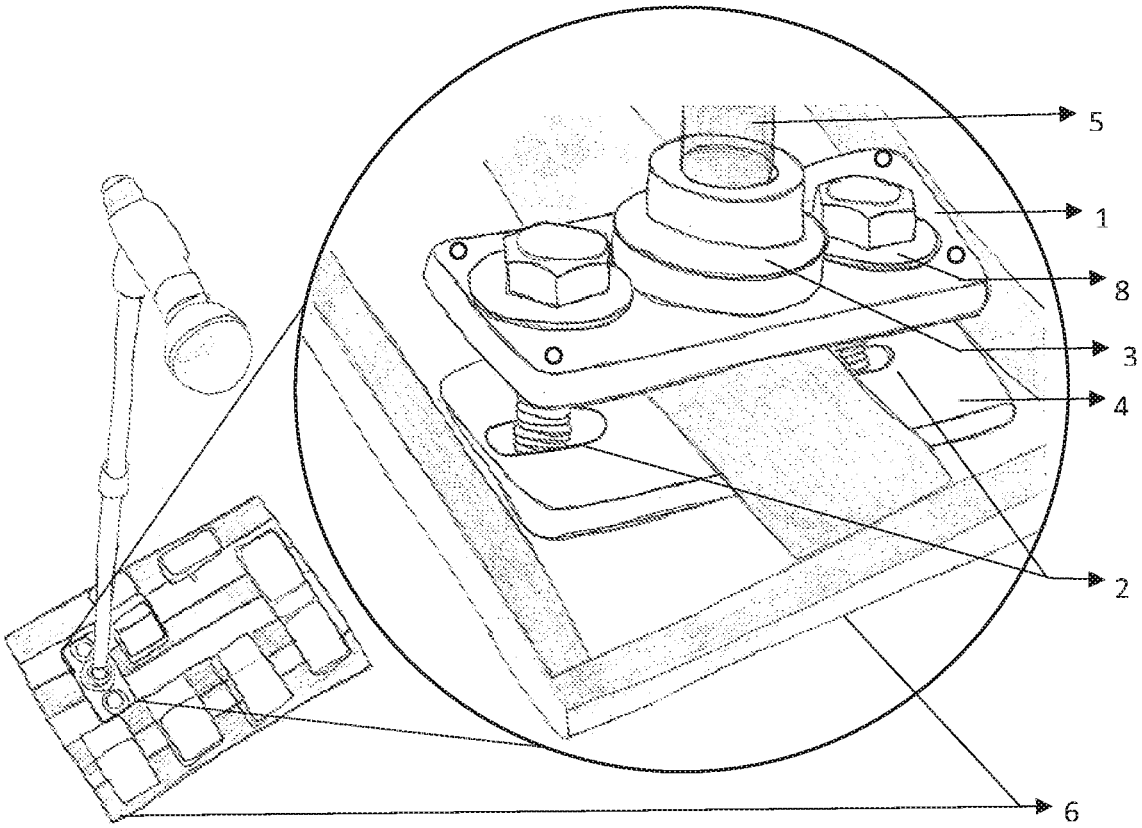
FIGURE 2: MODULAR STAND MOUNTED ON A SLAT/RAILING STYLE PEDAL BOARD
(part in the circle an enlarged portion of the mounted mod stand)

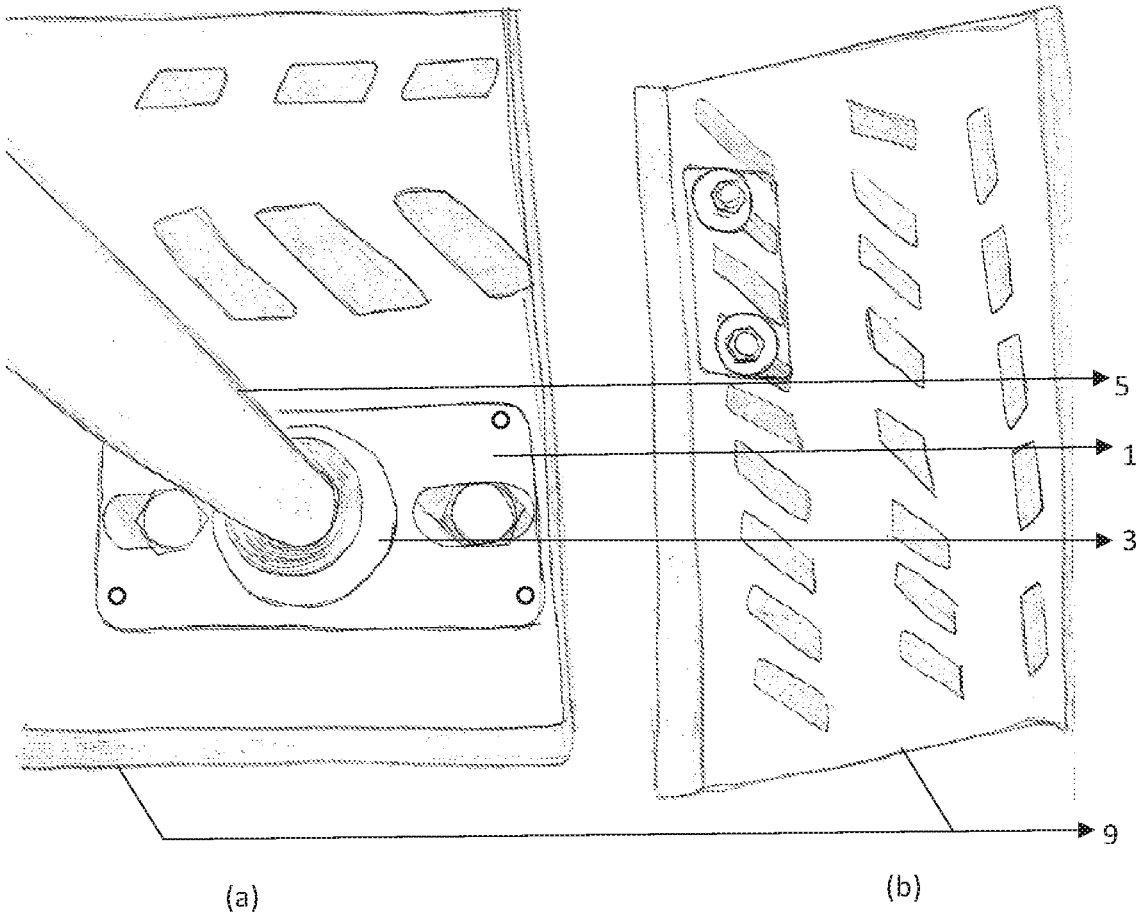
FIGURE 3: MODULAR STAND MOUNTED ON PEDAL BOARD WITH CHANNELING (a) front side view; (b) back side view.

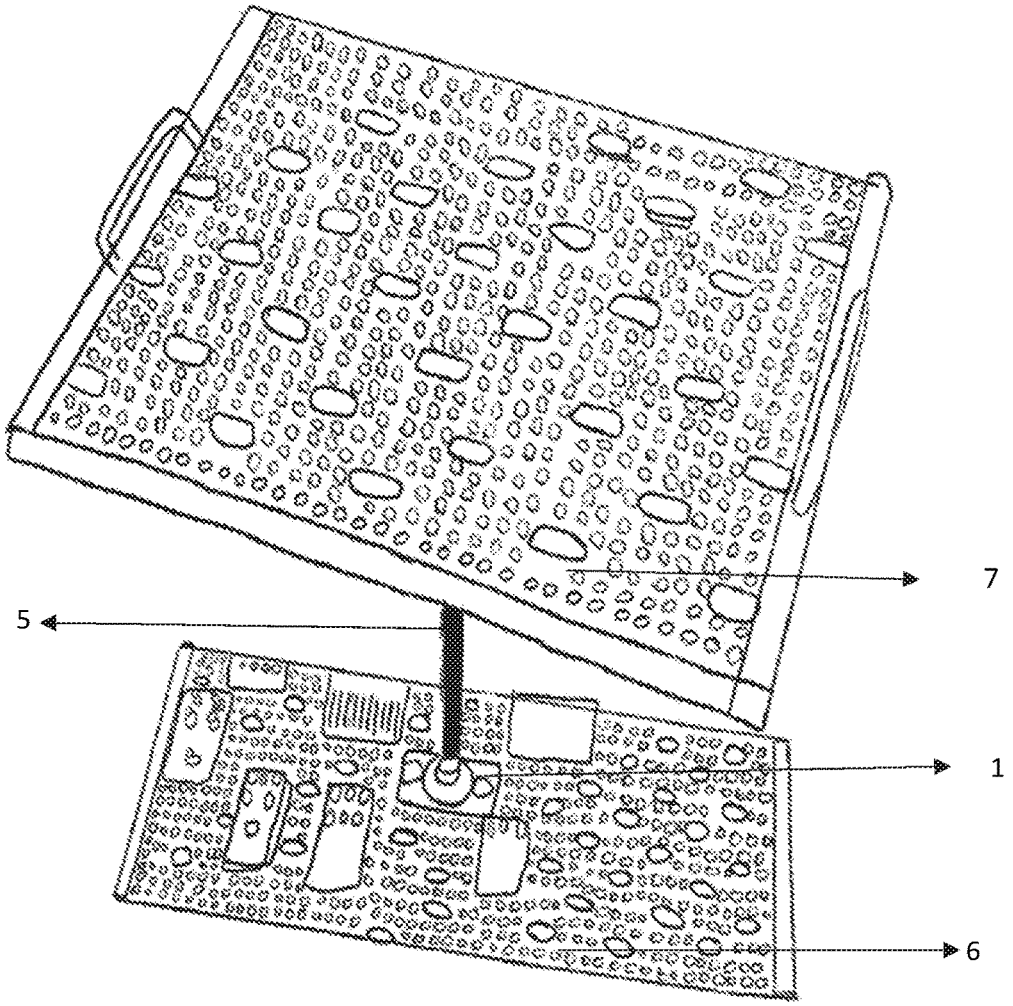
FIGURE 4: MODULAR STAND MOUNTED ON A PEDAL BOARD SUPPORTING A SECONDARY PEDAL BOARD

MODULAR STAND FOR CONNECTING A MICROPHONE STAND TO A PEDAL BOARD

FIELD

The present invention relates to stage equipment. More particularly, the present invention is related to a modular stand that connects a microphone stand to a pedal board in a convenient hassle-free manner.

BACKGROUND

Singers and other performers commonly use a) microphones on microphone stands to amplify their voices and b) pedal boards to control sound effects of musical instruments such as electrical guitars during their performance. A pedal board is placed on a floor to facilitate a musician turning the effect pedals on and off with his/her foot. Sometimes a musician may need to continually manipulate the effect pedal with his/her foot. However, this sort of arrangement of the pedal board interferes with microphone stands since a microphone stand typically includes a base located at the user's feet, exactly where pedal boards are most conveniently used. Thus, the microphone base prevents or blocks the use of the pedal board from being placed where it would otherwise most conveniently be used. Further, there is a lot of inter connected hard wires running on the stage around the performers feet preventing free movement of the performers on the stage. Accordingly, there is a need for an apparatus that facilitates simultaneous and hassle free use of microphone and pedal board that overcomes these problems.

The present invention solves the problem discussed above. The present invention provides a modular stand, which is a piece of hardware, which connects the microphone stand directly onto the pedal board thereby providing a musician with the ability to control the pedals while using the microphone stand at a single point.

SUMMARY

A modular stand is a piece of hardware that connects the microphone stand directly to the pedal board, said modular stand comprises a first flange, a pedal board; an identical second flange, wherein the first flange is a rectangular metal structure consisting of two openings at the two distal ends and a central protrusion having threading on the inside surface; wherein the second flange is a rectangular metal structure consisting of openings at the two distal ends; wherein the flanges are connected there between by sturdy means such as a nut and bolt assembly; and wherein the central protrusion provides a structural means to support a microphone stand.

DESCRIPTION OF THE FIGURES

FIG. 1 shows the first flange and an identical second flange of the modular stand in accordance with an embodiment of the invention.

FIG. 2 shows the top view of the modular stand mounted onto a slat style pedal board including an enlarged view of the mounted modular stand in accordance with an embodiment of the invention.

FIG. 3 shows the front and back side view of the modular stand mounted onto a pedal board with channeling in accordance with an embodiment of the invention.

FIG. 4 shows the modular stand mounted on a pedal board where the apparatus further supports a secondary pedal board in accordance with an embodiment of the invention.

DESCRIPTION OF THE PREFERRED EMBODIMENT

The invention is defined with reference to the appended claims. With respect to the claims, the glossary that follows provides the relevant definitions.

The first flange (1) according to this invention is a piece of metal hardware which is preferably rectangular in shape with two openings (2) at the two distal ends and four openings (10) at the four corners. Each opening may accommodate a connecting means such as metal bolt and nut assembly (8).

The first flange according to this invention also comprises of a central protrusion (3) that extends substantially vertically from the pedal board onto which the said flange may be thereby mounted. The central protrusion preferably comprises a hub with threading that is able to receive and securely hold the bottom end of the microphone stand in a substantially vertical orientation.

The second flange (4) according to this invention is identical to the first flange except that it does not contain the central protrusion (3).

A pedal board according to this invention is a platform for mounting numerous effect pedals by a releasable means. Pedal boards which are rectangular, box-like or orthogonal in shape are built of wood or metal, more preferably metal such as aluminum or lightweight aluminum. Currently marketed and available Pedal boards may be either a) rail/slat style pedalboard which have horizontally spaced rails or slats which provide real state to connect pedal effects. Example of marketed pedalboard which is railing or slat style is Pedaltrain® b) non-rail style pedal boards with channeling holes for connecting pedal effects and cable routing (example: marketed pedal board TEMPLET" audio or Gator).

A preferred embodiment of this invention is exemplified by FIG. 2 that shows a microphone stand with the microphone, connected to a slat style pedal board (6) by means of the two flanges [(1) and (4)]. More specifically, FIG. 2 depicts mounting the flanges on a slat or railing based pedal board (6) wherein the first flange (1) on the top and the second flange (4) on the bottom are arranged in a parallel fashion such that at least one of the railing of the pedal board (6) is sandwiched there between. The two flanges are connected at the distal two openings (2) by the means of a removable nut and bolt assembly (8). A microphone stand (5) is connected to the pedal board by threading the stand into the central protrusion (3) completing the modular stand apparatus with a unified pedal board and microphone.

A preferred embodiment of this invention as exemplified by FIG. 3 comprises of mounting the modular stand on a non-slat based pedal board with channels (9). In this particular embodiment, the first flange (1) may directly be mounted onto the channels of the pedal board (9) with the means of the nut and bolt assembly (2) with or without the need for the second flange (2). FIG. 3 also shows the back side of the pedal board (9) wherein the first flange (1) is directly connected to the pedal board by means of nut and bolt assembly. A microphone stand (5) is connected to the pedal board by threading the stand into the central protrusion (3) completing the modular stand apparatus with a unified pedal board and microphone.

According to an embodiment of this invention, the modular stand may be used with all types of pedal boards for example slat/railing based pedalboards or non-slat style pedalboards with channeling for cable routing.

According to an embodiment of this invention, the modular stand may be installed and uninstalled without any tools or modification to any existing pedal board in a variety of places on the pedal boards.

A further embodiment of this invention as exemplified by FIG. 4 comprises of mounting the modular stand on either a slat or channel based pedal board, and which stand further supports a secondary pedal board (7). A separate flange connects the secondary pedal board (7) with the top of the microphone stand. This flange is identical to the first flange except that it has a central protrusion with a threading means for connecting the top end of the microphone stand.

A further embodiment of this invention comprises of mounting the modular stand on a pedal board or a surface using the openings (10) in the four corners of the first flange. The modular stand in this embodiment provides mounting options on atypical surfaces not covered above. For example, the flange maybe connected onto a hardwood surface by connecting means such as screws in the four corner openings (10) of the flange. The modular stand in this embodiment may require tools for installing the flange onto the said surface.

While the invention has been described above with reference to specific embodiments thereof, it is apparent that many changes, modifications, and variations can be made without departing from the inventive concept disclosed herein, and such description is not intended as limitations on the scope thereof. Accordingly, it is intended to embrace all such changes, modifications, and variations that fall within the spirit and broad scope of the appended claims.

What is claimed is:

1. A modular stand comprising:

a first flange (1);

a pedal board;

and a second flange (4);

wherein the first flange is a metal structure comprising of two openings (2) and a central protrusion;

wherein the second flange is a metal structure comprising of two openings (2);

wherein the flanges are connected there between at the openings;

wherein the central protrusion (3) provides a structural means to support a microphone stand.

2. The modular stand of claim 1, wherein the two opening of the first flange and the second flange are at the distal end thereof.

3. The modular stand of claim 1, wherein the flanges are connected there between by means of a nut and bolt assembly.

4. The modular stand of claim 1, wherein the first flange comprises of four openings (10) at the corners thereof.

5. The modular stand of claim 1, wherein the pedal board is a railing style pedal board.

6. A method of connecting a microphone stand to a pedal board comprising using the modular stand of claim 1, wherein the modular stand comprises of a means to attach itself to said pedal board and further comprises a means to receive said microphone stand.

7. The method of claim 6, wherein the pedal board is a railing style pedal board.

* * * * *